US005870777A

United States Patent [19]

Hans

[11] Patent Number: 5,870,777

[45] **Date of Patent: *Feb. 16, 1999**

[54] ATHLETIC PANTS WITH BACK POCKET

[76] Inventor: Gerald L. Hans, 2624 Green Oak Pl., Los Angeles, Calif. 90068

[ * ] Notice: The term of this patent shall not extend beyond the expiration date of Pat. No. 5,724,679.

[21] Appl. No.: 960,964

[22] Filed: Oct. 30, 1997

Related U.S. Application Data

[63] Continuation-in-part of Ser. No. 698,022, Aug. 15, 1996, Pat. No. 5,724,679.

[51] Int. Cl.[6] ..... A41D 1/06

[52] U.S. Cl. ..... 2/238; 2/247; 2/249; 2/228

[58] Field of Search ..... 2/238, 228, 227, 2/247, 249, 250, 252, 253, 67, 94, 248

[56] References Cited

U.S. PATENT DOCUMENTS

| | | | |
|---|---|---|---|
| 3,010,111 | 11/1961 | Ralph | 2/249 |
| 3,744,059 | 7/1973 | Hayes | 2/250 |
| 3,871,030 | 3/1975 | Green | 2/238 |
| 4,079,871 | 3/1978 | Sica | 2/247 |
| 5,031,244 | 7/1991 | Inagaki | 2/102 |
| 5,477,562 | 12/1995 | Dixon | 2/250 |
| 5,724,679 | 3/1998 | Hans | 2/238 |

OTHER PUBLICATIONS

Two pages of advertising from the Fleet Feet Conference at Squaw Valley, Lake Tahoe, California, held between Aug. 6–9, 1995.

List of franchisees present at the Fleet Feet Conference at Squaw Valley, Lake Tahoe, California, held between Aug. 6–9, 1995.

Letter dated Aug. 14, 1995 to Mr. Casey Long, Marketing Manager of Fleet Feet, Inc. from Mary Button and Gerry Hans.

Letter dated Aug. 16, 1995 from Casey Long, Marketing Manager of Fleet Feet, Inc., to Mary Button and Gerry Hans.

Press Release dated Aug. 24, 1995.

Packing list for order dated Aug. 29, 1995.

One copy each of two invoices.

Copy of the Fact Sheet for the 1995 Philadelphia Distance Run, Philadelphia, PA.

Photograph of Prototype athletic pants.

Brochure with picture of LD Short, male style, #2001LD.

*Primary Examiner*—Gloria M. Hale
*Attorney, Agent, or Firm*—Sheldon & Mak

[57] ABSTRACT

A single layer pocket 82 is provided in which left edge portion 88 and right edge portion 89 of the single layer 86 are spaced apart from the left edge portion and right edge portion of the back panel 14. The pocket 82 is equipped with a flexibly rigid curvilinear shaped rib element 100 affixed vertically to the pocket, and a similar rib element 110 that extends laterally across the pocket 82.

21 Claims, 4 Drawing Sheets

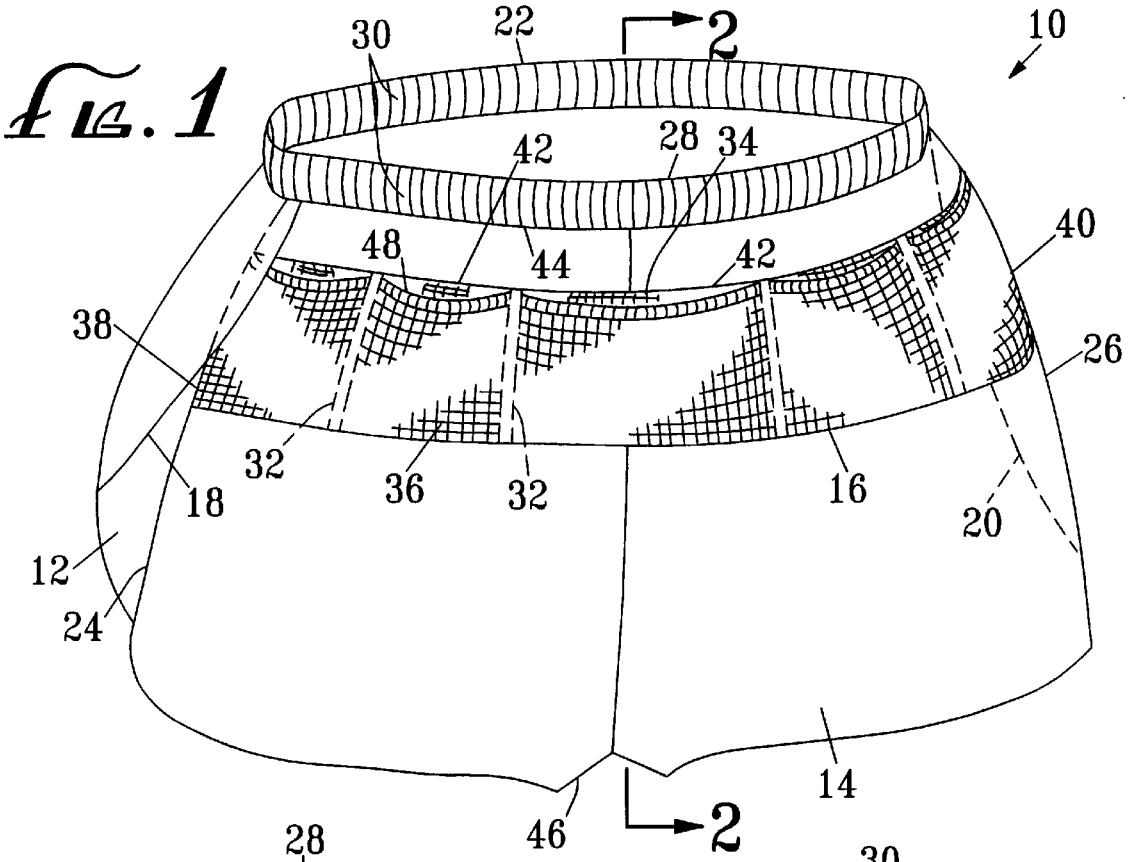
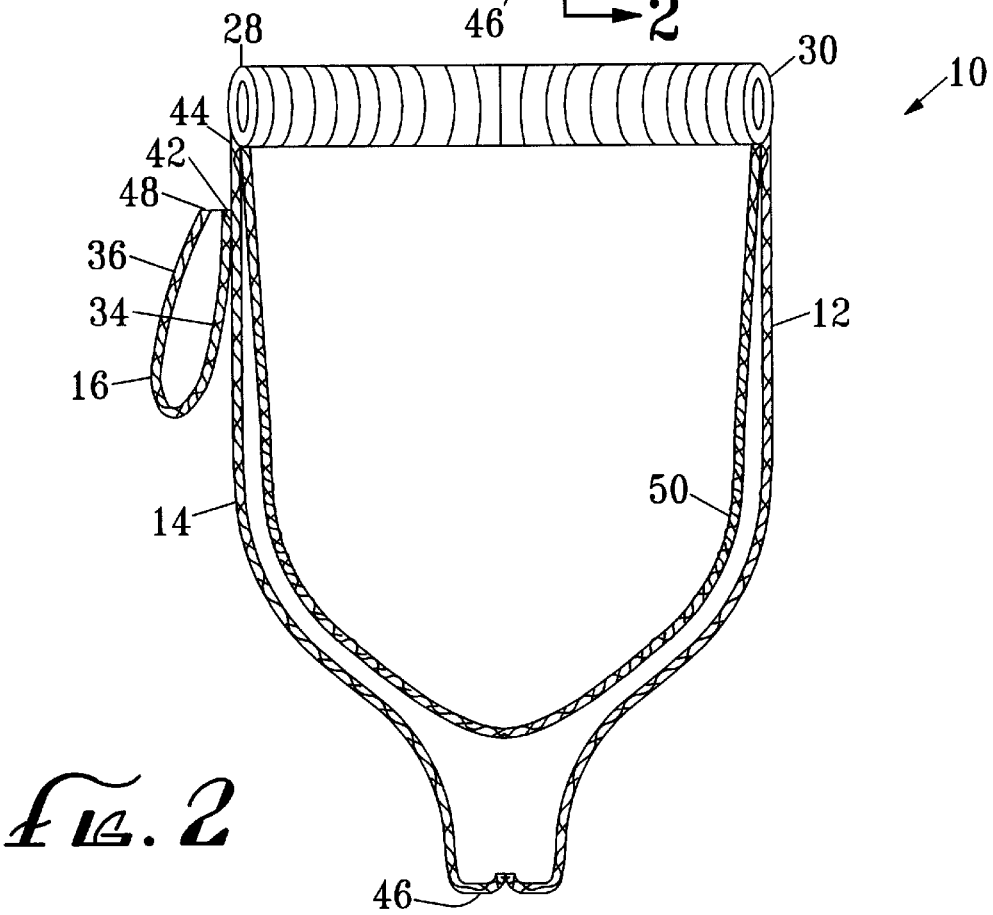
FIG. 2

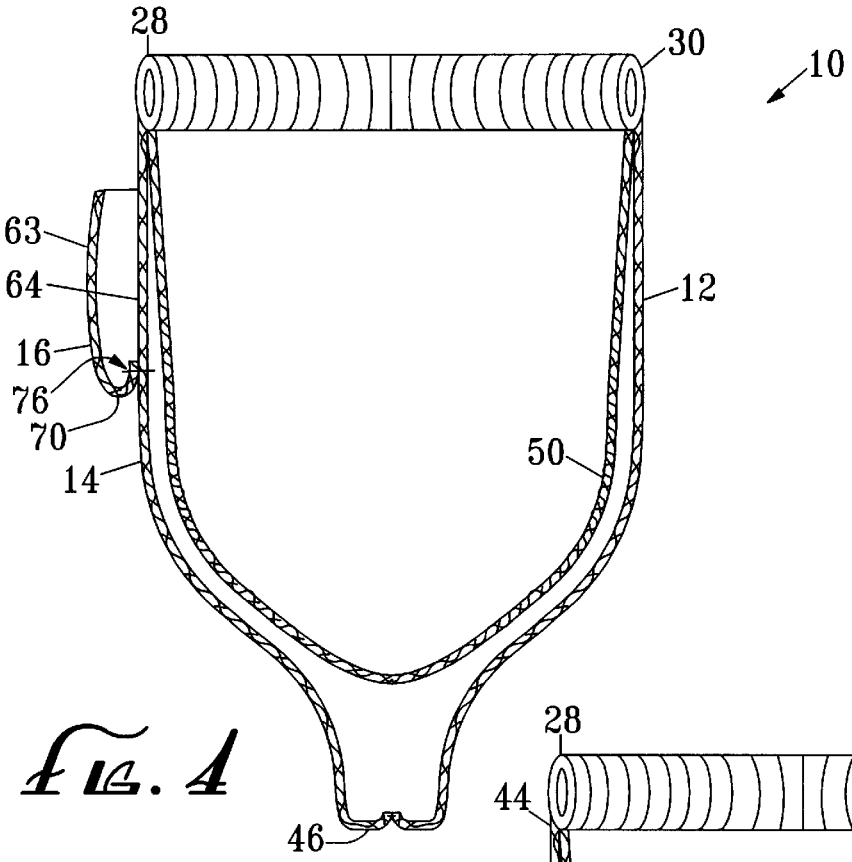
FIG. 4
FIG. 6
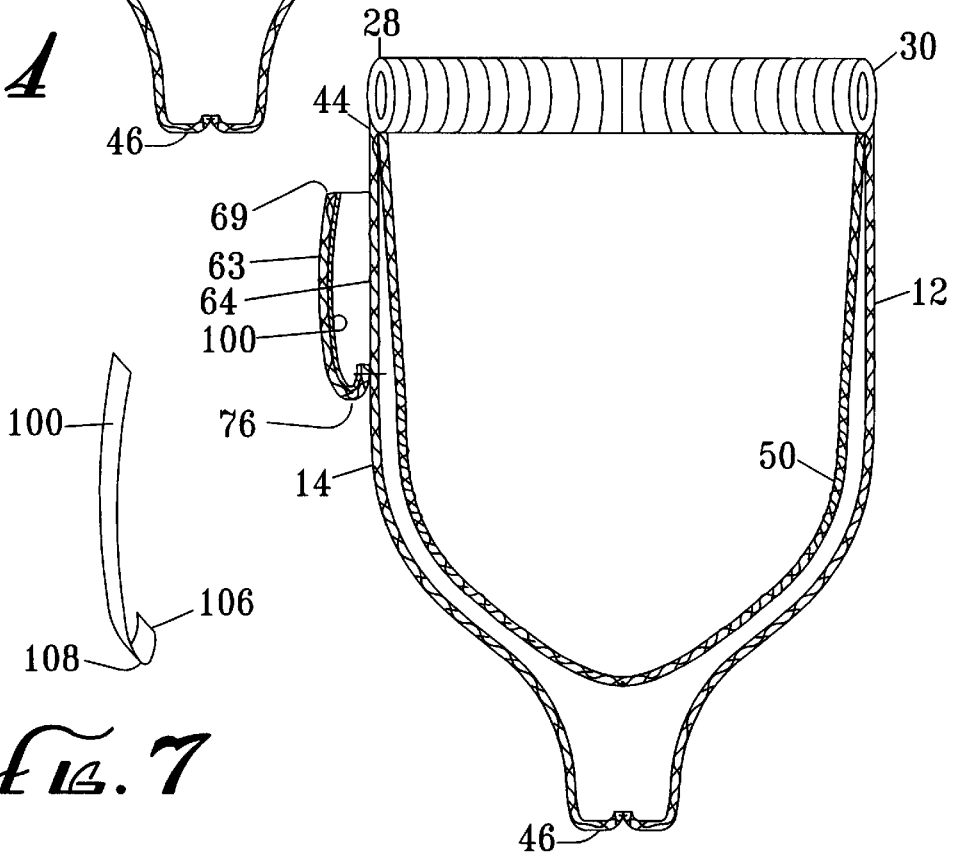
FIG. 7

ATHLETIC PANTS WITH BACK POCKET

CROSS-REFERENCE TO RELATED APPLICATIONS

This application is a continuation-in-part of U.S. patent application Ser. No. 08/698,022 filed Aug. 15, 1996, now U.S. Pat. No. 5,724,679 issued Mar. 10, 1998.

BACKGROUND

Specially designed pants have been constructed for a variety of athletic activities, including running, rollerblading, skating and biking. While performing such sporting activities, it is often useful for athletes to carry items such as medicines, keys, money, sunglasses, energy bars or energy packets. For this purpose, an athlete will frequently wear a jersey having pockets for carrying such items, or will wear a pouch attached to his or her waist by a strap.

Pockets on jerseys, however, can restrict movement during sporting activities and items in jersey pockets tend to bounce against the athlete causing a degradation in performance. Further, athletes will often perform sports without wearing a jersey due to the high ambient temperature or to the restrictions in movement caused by jerseys. Further, pouches can affect the athletes' aerodynamics and can hinder movement during sports, disadvantageously affecting performance. Therefore, many athletic pants incorporate one or more pockets for holding items.

Pockets in athletic pants are of several types. Some pockets hold items between the outer layer of the pants and the athlete's skin. These pockets can cause the items to chafe during the sporting activity. Further, nutritional items can melt due to excessive heat generated by the athlete's body during the activity.

Other pockets in athletic pants are attached externally to the outer layer of the pants. These pockets tend to catch air during the athletic activity and, thus, degrade the athletes' performance. Further, items held by some external pockets tend to bounce excessively during the activity further affecting the athlete's performance. Also, item held by conventional pockets are difficult to retrieve, especially while performing activities involving running or jogging.

It would, therefore, be advantageous to have athletic pants that incorporate a pocket for carrying items, where the pocket does not subject the items to the extra heat generated by the athlete's body, that offer minimal resistance to air, and that minimize how much bounce the items are subjected to during the athletic activities. It would also be advantageous to have athletic pants that incorporate a pocket that allows for easy, convenient retrieval of items, particularly while performing athletic activities.

SUMMARY

There is provided athletic pants equipped with an expandable pocket structure constructed with a front panel that is formed with left and right edge portions and a back panel having left and right edge portions. The panels are freely movable relative one another with the respective left and right edge portions of each of the panels being partially attached along the respective edge portions.

In one preferred embodiment of the athletic pants the pocket structure is made of an inner layer and an outer layer that extend across the back panel. Each layer of the pocket structure has left and right edge portions that are affixed to the left and right edge portions of the back panel.

In another embodiment the inner layer and outer layer are formed by folding one layer over another and affixing the edge portions to the corresponding edge portions of the back panel.

In yet another preferred embodiment the pocket is constructed of a single layer having left, right, bottom and top edge portions that overly the outer surface of the back panel and the left and right edge portions of the single layer are affixed to the left and right edge portions of the back panel and the bottom layer is affixed to the outer surface of the back panel and the top edge portion resides adjacent the waist band of the athletic pants.

There is yet a further preferred embodiment in the pocket structure which is formed of a single layer including, left, right, bottom and top edge portions which is disposed between the left and right edge portions of the back panel such that the pocket edge portions are spaced inward and apart from the left and right edge portions of the back panel. The smaller pocket may be centered on the back panel. The smaller pocket is equipped with flexible rib support elements affixed laterally across the single layer or alternatively being vertically disposed between the top and bottom edge portions of the single layer to support the single layer in spaced apart relationship from the outer surface of the back panel.

In a still further preferred embodiment the flexible rib elements may be placed adjacent to left and right edge portions of the single layer pocket.

BRIEF DESCRIPTION OF THE DRAWINGS

These figures, aspects and advantages of the present invention will become better understood with regard to the following description, appended claims and accompanying figures where:

FIG. 1 is a back, left side perspective view of athletic pants having features of the present invention;

FIG. 2 is a cross-sectional view of the athletic pants of FIG. 1 taken along line 2—2;

FIG. 4 is a cross-section taken along 4—4 of FIG. 3 showing the manner of affixing the bottom edge of the single layer to the outer surface of the back panel; and FIG. 6 is a cross-section taken along 6—6 of FIG. 5 showing the single layer structure equipped with the vertically flexible rib element.

FIG. 7 is an enlarged detail of the flexible rib element of FIG. 5.

DETAILED DESCRIPTION

Figure 3:
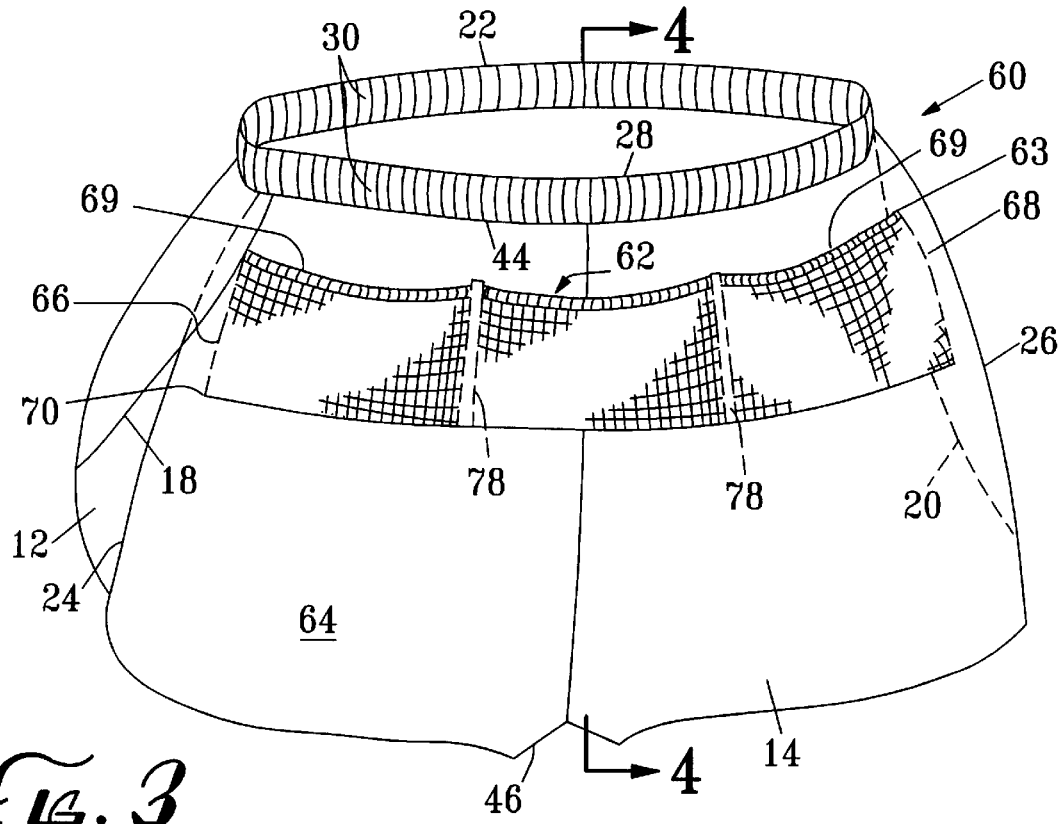
FIG. 3 is a perspective view of the back panel showing the left side of the front panel and illustrating the single layer pocket structure.

In one embodiment, the present invention is a pair of athletic pants having at least one pocket connected to the back of the athletic pants, where the pocket is formed by an inner and outer layer of material, and where the inner layer comprises a mesh material. In the following description those parts of the athletic pants which are the same in the various figures will bear the same identifying numerals.

Referring now to FIGS. 1 and 2, there is shown a back, left perspective view of a pair of athletic pants 10 according to the present invention, and a side crosssectional view of the pants 10 taken along line 2—2, respectively. As can be seen, the pants 10 comprise a front panel 12 and a back panel 14 and a pocket 16 affixed to the external surface of the back panel 14. The front panel 12 has a left edge 18, a right edge 20 and a top edge 22. Similarly, the back panel 14 has a left edge 24, a right edge 26, and a top edge 28. The left edge 18 of the front panel 12 is connected over at least part of its length to the back panel 14. Similarly, the right edge 20 of the front panel 12 is connected over at least part of its length to the back panel 14. Additionally, either the top edge of the front panel 22 or the top edge of the back panel 28 can comprise a waistband 30 that can be elasticized or can incorporate a drawstring to adjust the fit of the garment 10.

The athletic pants 10 further comprise at least one pocket 16 attached to the external surface of the back panel 14. In a preferred embodiment, the pocket 16 is subdivided into a plurality of pockets by one or more seams 32, such as the five smaller pockets shown in FIG. 1. In another preferred embodiment, the athletic pants comprise a plurality of separate pockets, each constructed according to the present invention.

As can be better appreciated in FIG. 2, the pocket 16 has an inner layer 34 adjacent the back panel 14 and an outer layer 36 external to the inner layer 34. In a preferred embodiment, the inner layer 34 is attached to the back panel 14 at a left edge 38, a right edge 40 and an upper edge 42. The pocket 16 can also be attached to the back panel 14 by the one or more seams 32, which serve to divide the pocket 16 into a plurality of smaller pockets. In a preferred embodiment, the upper edge 42 of the inner layer 34 is about 2 to 3 cm below the bottom edge 44 of the waistband 30, when present, or about 7 cm below the top edge 28 of the back panel 14. This arrangement allows items carried in the pocket 16 to rest on the upper portion of the gluteal region of the wearer for convenient access with either hand without disruption of athletic activity. Further, this arrangement provides a stable platform where relatively less movement occurs during sporting activities, and therefore subjects items within the pockets according to the present invention to less bouncing.

The inseam 46 of the pants 10 can be less than about 15 cm, as shown in the Figures, or can be long enough to cover the athlete's entire lower extremities, down to the ankle or including the foot. Alternately, the athletic pants 10 can have an inseam 46 at any intermediate length, such as is appropriate to cover some or all of the athlete's thigh, knee, or calf. As will be understood to those with skill in the art, different inseams serve to provide protection and retain heat as needed for various sporting activities and for various ambient temperatures.

Referring to FIG. 3 there is shown another preferred embodiment identified with the general reference numeral 60 in which the pocket structure 62 is formed of a single layer 63. The single layer 63 extends across the outer surface 64 of the back panel 14 in which the left and right edge portions 24 and 26 are respectively affixed to the left and right edge portions 66 and 68 of the single layer 63. The top edge portion 69 of the single layer 63 is adjacent the waist band 22 and optionally may have an elastic band (not shown) towards the top edge 69 urging the top edge 69 of the layer 63 against the outer surface 64 of the back panel 14.

Referring to FIG. 4 the bottom edge portion 70 of the single layer 63 has a slight under-fold or lip portion 76 which permits stitching or otherwise affixing the single layer 63 to the outer surface 64. It will be appreciated that the pocket structure 62 is formed of a single layer 63 and that the pocket structure is completed with the outer surface 64 of the back panel 14 serving as the inner layer of the pocket. As shown in FIG. 3 the pocket 62 can optionally be stitched or otherwise affixed to the back panel 14 by a series of stitching mesh fabric from the bottom edge 70 to the top edge 69 thereby forming a series of separations or divisions of the continuous single layer 63 into smaller pockets.

Figure 5:
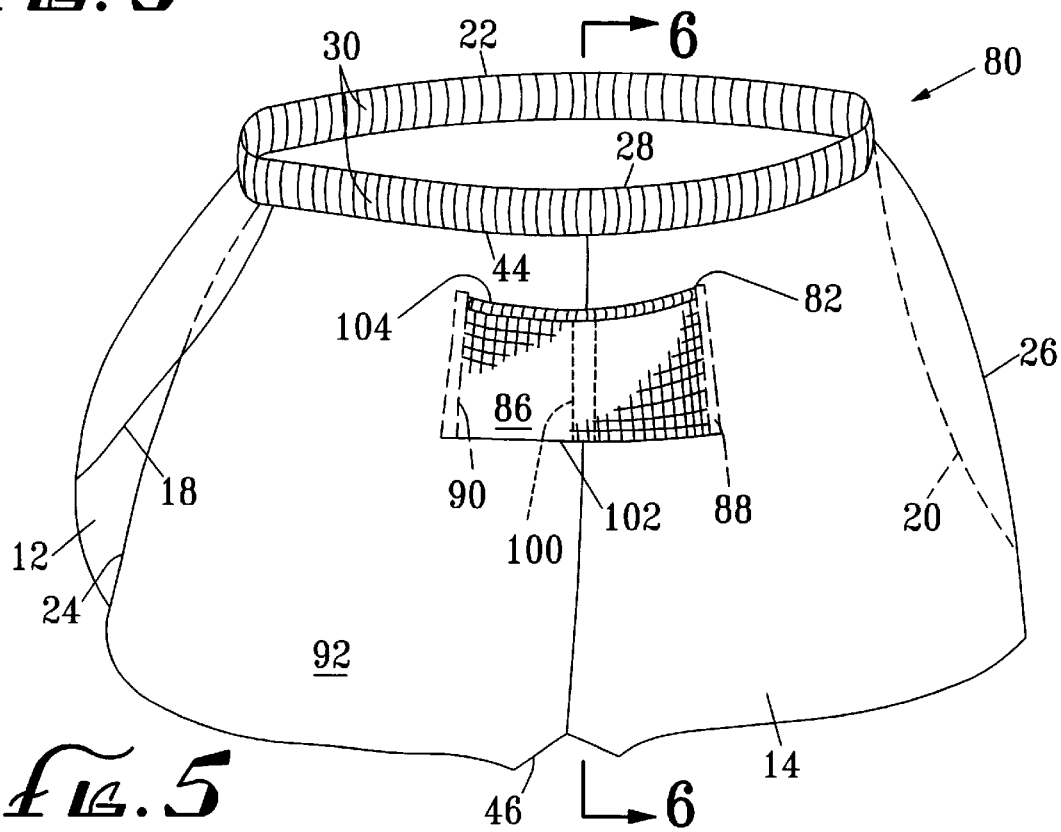
FIG. 5 is a perspective view of the back panel showing the left side of the front panel and illustrating the single layer pocket structure equipped with the vertically extending rib element supporting the layer in spaced apart relationship from the outer surface of the back panel.

In another embodiment of the athletic pants of the instant invention there is provided a smaller pocket construction as shown in FIG. 5. The athletic pants identified generally with the reference numeral 80 is similar in construction to FIGS. 1 and 2 with the exception that the pocket structure 82 is smaller in size in that it does not extend fully across the lateral extent of the back panel 14. There is often the need for a smaller pocket that meets the requirements set forth in the background of the invention including ready accessibility for the person wearing the athletic pants to deposit and retrieve articles put into the smaller sized pocket. The pocket 82 like the pocket structure described in connection with FIG. 3 comprises a single outer layer 86 which spans the mid section of the back panel 14 with its lateral edges 88 and 90 spaced inward from the right and left edges 20 and 24 of the back panel 14 respectively.

In order to assure that the wearer of the athletic pants may conveniently have access to the pocket to both deposit and retrieve items into and out of the pocket it has been found advantageous to use a flexibly rigid curvilinear rib element 100. With the aid of the flexibly rigid rib element 100 the single layer 62 is maintained in spaced apart relationship from the back panel 14 and still provides sufficient closure to securely hold items deposited therein from falling out. The rib element 100 is formed of a thin plastic material that is imparted a bowed or curved shape the degree of curvature being commensurate with the amount of spacing that is required to maintain the single layer 82 apart from the back panel 14. The rib element 100 may be formed of various plastic materials such as cellulose acetate, polyvinyl acetate, or polyacrylate and the like and having a thickness in the range of 0.015 to 0.035 inches. The rib element 100 preferably should extend vertically from the bottom edge 102 to the top edge 104 of the single layer 82.

While the rib element 100 is shown at the center of the single layer 82 it will be understood that a pair of rib elements 90 may be affixed at each of the lateral edges 90 and 88.

As shown in FIG. 6 the shape of the rib element 100 is formed with a slight lip portion 106 which is curved inward so that it presents a smooth edge 108 with the back panel 14. The rib element is sufficiently thin and formed of material permitting it to be stitched in with the single layer 82. Other techniques may be used to affix the rib such as with an adhesive or intertwining it into the mesh fabric itself and securing its extremities by stitching or gluing.

Figure 8:
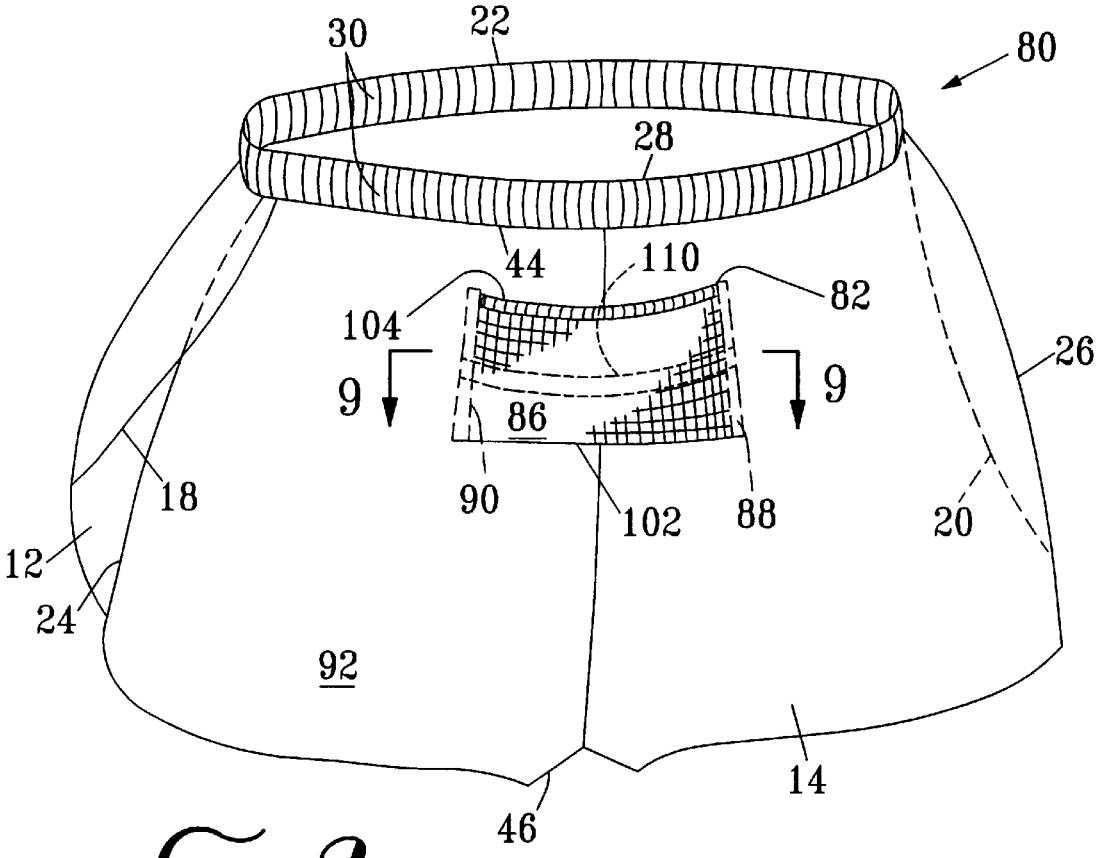
FIG. 8 is a perspective similar to FIG. 5 showing the single layer pocket structure with the rib element affixed laterally extending across the single layer.

In another embodiment another form of the flexibly rigid curvilinear shaped rib element may be positioned laterally within the layer 82 as shown in FIG. 8. The rib element 110 may be affixed mid-way between the top edge 104 and bottom edge 102 of the layer 82.

Figure 9:
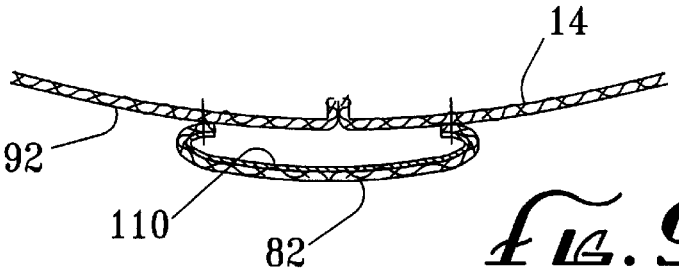
FIG. 9 is a cross-section taken along 9—9 of FIG. 8 showing the single layer structure equipped with the laterally extended flexible rib element.
Figure 10:
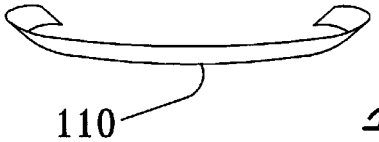
FIG. 10 is an enlarged perspective of the rib element of FIG. 9.

Referring to FIGS. 9 and 10 there is shown the flexibly rigid curvilinear rib element 110 affixed to the inside of the single layer mesh.

The athletic pants 10 can comprise a variety of materials as will be understood by those with skill in the art. In a preferred embodiment, the back panel and the front panel are formed from a lightweight durable fabric such as nylon or polyester. The fabric can be a stretchable material such as a spandex combination fabric to provide a form fit for activities such as biking. Other materials such as Supplex (trade name for nylon fabric by DuPont) are also suitable.

The pockets 16, 63 and 82 can comprise a variety of materials. In a preferred embodiment, the inner layer 34 is a mesh material. In a particularly preferred embodiment, both the inner layer 34 and the outer layer 36 comprise a mesh material. Suitable mesh materials for the pocket include Coolmax mesh, (Cyberknit, New York, N.Y.), nylon/spandex mesh (H. Warshow & Sons, New York, N.Y.), and polyester/spandex mesh (E.F.A., New York, N.Y.), nylon mesh (John King, Los Angeles, Calif.).

In the preferred embodiments, the mesh material is Coolmax mesh (DuPont polyester) available from Summit Knitting, New York, N.Y., and having holes in the mesh approximately 1 mm in diameter in the unstretched condition, with approximately 16 holes evenly spaced per $cm^2$. This fabric has approximately 10% stretch horizontally and 50% stretch vertically in the configuration used in the present invention. This configuration is particularly advantageous for decreasing the amount of bounce to which items in the pocket is subjected during sporting activities. Other types of mesh are also useful in the present invention. For example, mesh having holes approximately 0.25 to 2.0 mm in diameter, with between approximately 5 and 50 holes per $cm^2$ would also be within the scope of the present invention.

In a preferred embodiment, an elastic strip is incorporated into the upper edge 48 of the outer layer 36. The elastic preferably has a linear length without applied horizontal tension that is approximately 90% of the linear length of the upper edge 48 of the outer layer 36 under horizontal tension. This configuration tends to keep small objects fully within the pocket 16 and to more securely hold large objects in place that extend outside of the pocket 16. Further, the elastic allows for easy removal of items, unlike closures using Velcro or zippers.

The various embodiments of the athletic pants described herein namely 10, 60 and 80 each having pocket structures 16, 62 and 82 have several advantages over conventional athletic pants with other types of pockets. First, the use of mesh for each of the pocket structures adds minimal weight to the garments and secondly it allows air to pass through the pockets thereby decreasing the resistance to drag during the supporting activity. Further, liquids such as rain or sweat, tend to pass through the pockets rather than accumulating within. Of particularly advantage, items within the various pocket structures tend to bounce less during sporting activities then items in conventional pockets. This is especially true of the single layer embodiments namely 63 (FIG. 3), 82 (FIG. 5) and 80 (FIG. 8). Also, items in the pocket structures described herein according to the present invention can be conveniently retrieved, particularly during activities involving running.

Although the present invention has been discussed in considerable detail with reference to certain preferred embodiments, other embodiments are possible. For example, the athletic pants 10 can further comprise an inner liner 50 that fits more closely against the athlete's body. Therefore, the spirit and scope of the appended claims should not be limited to the description of preferred embodiments contained herein.

I claim:

1. Athletic pants equipped with an expandable pocket structure, said athletic pants comprising:

a front panel formed with left edge and right edge portions;

a back panel having an inner surface and an outer surface and formed with left, right and top edge portions; said left and right edge portions of the front and back panel being at least partially attached along the respective edge portions, thereby enabling the panels to move freely relative to one another; said front panel and back panel forming leg openings having an inseam;

said pocket structure comprising:

a single layer that overlies the outer surface of the back panel, said single layer including left, right and bottom portions forming an enclosure with said left and right edge portions affixed to the corresponding edge portions of the back panel and said bottom portion affixed to the back panel, whereby the single layer overlies the outer surface of the back panel forming an expandable pocket structure.

2. The athletic pants of claim 1, wherein the single layer comprises a mesh fabric.

3. The athletic pants of claim 1, wherein the mesh has openings approximately 0.25 to 2.0 mm in diameter.

4. The athletic pants of claim 1, wherein the mesh has openings that range from 5 to 50 openings per $cm^2$.

5. The athletic pants of claim 1, having an inseam, and wherein the inseam is less than about 15 cm in length.

6. The athletic pants of claim 1, wherein the outer layer has a top edge comprising an elasticized material.

7. The athletic pants of claim 6, wherein the top edge of the outer layer has a linear length under horizontal tension and wherein the elasticized material has a linear length without applied horizontal tension that is approximately 90% of the linear length of the top edge of the outer layer under horizontal tension.

8. The athletic pants of claim 1, wherein the pocket is divided into at least 3 pockets.

9. The athletic pants of claim 8, wherein at least one of the single layer pockets has affixed a flexibly rigid curvilinear shaped rib element.

10. Athletic pants comprising:

a front panel with left and right edge portions;

a back panel having an inner surface and outer surface and formed with left, right and top edge portions, said left and right edge portions of the front and back panels being at least partially attached along the respective edge portions, thereby enabling the panels to move freely relative to one another;

a waist band surrounding said front and back panels;

an expandable pocket structure affixed to the back panel, said pocket structure comprising:

a single layer including left, right, bottom and top edge portions overlying the outer surface of the back panel, the left and right edge portions spaced apart from the left and right edge portions respectively of the back panel with its top edge portion adjacent the waist band, and the left, right and the bottom edge portions affixed to the back panel, said single layer further including a flexibly curvilinear shaped rib element attached to the single layer for supporting the layer in spaced apart relation from the outer surface of the back panel.

11. The athletic pants as claimed in claim 10, wherein the flexibly rigid curvilinear shaped rib element is affixed to said single layer, said curvilinear shaped rib element extending vertically from the bottom edge portion to the top edge portion.

12. The athletic pants as claimed in claim 10, wherein the left and right edge portions of the single layer have attached thereto the flexibly rigid curvilinear shaped rib element extending laterally from left edge portion to the right edge portion of the single layer.

13. The athletic pants as claimed in claim 10, wherein the left, right edge and bottom edge portions of the single layer are affixed to the back panel.

14. The athletic pants as claimed in claim 12, wherein said flexibly rigid curvilinear shaped rib element is formed with a lip section that turns toward the single layer.

15. The athletic pants as claimed in 10, wherein the flexibly rigid curvilinear shaped rib element is affixed to the outer surface of the single layer.

16. The athletic pants as claimed in claim 11, wherein the flexibly rigid curvilinear shaped rib element is affixed to the inner surface of the single layer adjacent to back panel.

17. The athletic pants comprising:

a front panel formed with left edge and right edge portions;

a back panel having an inner surface and an outer surface and formed with left, right and top edge portions, said left and right edge portions of the front panel being at least partially attached along the respective edge portions, thereby, enabling the panels to move freely relative to one another;

said pocket structure comprising:

a single layer overlying the outer surface of the back panel, said single layer including left, right and bottom portions forming an enclosure by affixing said left and right edge portions of the single layer to the corresponding edge portions of the back panel, and said bottom portion being affixed to the back panel, a flexibly rigid curvilinear rib element affixed to the single layer causing the single layer to be maintained in a spaced apart relation from the outer surface of the back panel.

18. The athletic pants as claimed in claim 17 wherein the flexibly rigid curvilinear shaped rib element extends laterally across the single layer from the left and right edge portions.

19. The athletic pants as claimed in claim 17 wherein the flexibly rigid curvilinear shaped rib element extends vertically from the bottom edge portion to the top edge portion of the single layer.

20. The athletic pants as claimed in claim 1 wherein the pocket structure comprises multiple pockets.

21. The athletic pants as claimed in claim 1, wherein the pocket structure is divided into at least two pockets.

* * * * *